US007163271B2

(12) United States Patent
Murcia et al.

(10) Patent No.: US 7,163,271 B2
(45) Date of Patent: Jan. 16, 2007

(54) ADJUSTING IMAGE-FORMATION MECHANISM SWATH SO THAT BAR CODES ARE FORMED WITHIN A SINGLE SWATH

(75) Inventors: Antoni S Murcia, Poway, CA (US); Yinan Xu, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/010,044

(22) Filed: Dec. 11, 2004

(65) Prior Publication Data

US 2006/0125866 A1 Jun. 15, 2006

(51) Int. Cl.
*B41J 29/38* (2006.01)
*B41J 23/00* (2006.01)

(52) U.S. Cl. ..... 347/16; 347/37

(58) Field of Classification Search ..... None
See application file for complete search history.

(56) References Cited

U.S. PATENT DOCUMENTS 6,367,910 B1 * 4/2002 Sette et al. ..... 347/37

* cited by examiner

*Primary Examiner*—Thinh Nguyen

(57) ABSTRACT

A method of an embodiment of the invention determines whether at least a portion of an image to be formed on a media sheet on a swath-by-swath basis by an image-formation mechanism includes one or more bar codes having a height that is less than a height of a swath of the image-formation mechanism. The mechanism adjusts the swath of the image-formation mechanism so that the bar codes are formed as part of the image on the media sheet within a single swath by the image-formation mechanism.

19 Claims, 3 Drawing Sheets

ADJUSTING IMAGE-FORMATION MECHANISM SWATH SO THAT BAR CODES ARE FORMED WITHIN A SINGLE SWATH

BACKGROUND

Inkjet printers are image-formation devices that form images on media, such as sheets of paper, by ejecting fluid, specifically ink, onto the media in accordance with the images desired to be formed on the media. Most inkjet printers operate by ejecting ink on a swath-by-swath basis, where a swath can extend from one side of a media sheet to the other side, and has a given height. One or more printheads of an inkjet printer first are scanned over a current swath of the media, ejecting ink as they are scanned over this swath. The media is then typically advanced by one swath, so that the printheads are able to be scanned over and eject ink onto the next swath.

Inkjet-printing technology has sufficiently advanced so that media advancement on a swath-by-swath basis can be precisely controlled. Therefore, the swaths of the resulting image formed on a media sheet cannot usually be individually discerned. However, exceptions remain. For instance, bar codes, which are series of vertical lines of varying thickness, that are formed over two consecutive swaths are difficult to print precisely. As a result, the part of a bar code formed on a first swath and the part of the bar code formed on a next swath may be able to be discerned, owing to the vertical lines of the bar code enhancing any differentiation in the printing of the different swaths.

For example, small gaps between swaths, or small overlaps between swaths, resulting from less than perfect media advancement, are visually accentuated by bar codes. The inkjet printheads may also scan the width of the media sheet in one direction to form the first swath containing one part of a bar code and be scanned in the opposite direction to form the next swath containing another part of the bar code. Slight imperfections in the ejection of ink due to the different directions in which the printheads were scanned may result. Although such imperfections are difficult to discern with most image features formed on the media, they are more readily apparent with bar codes, resulting in a decrease in perceived image quality.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
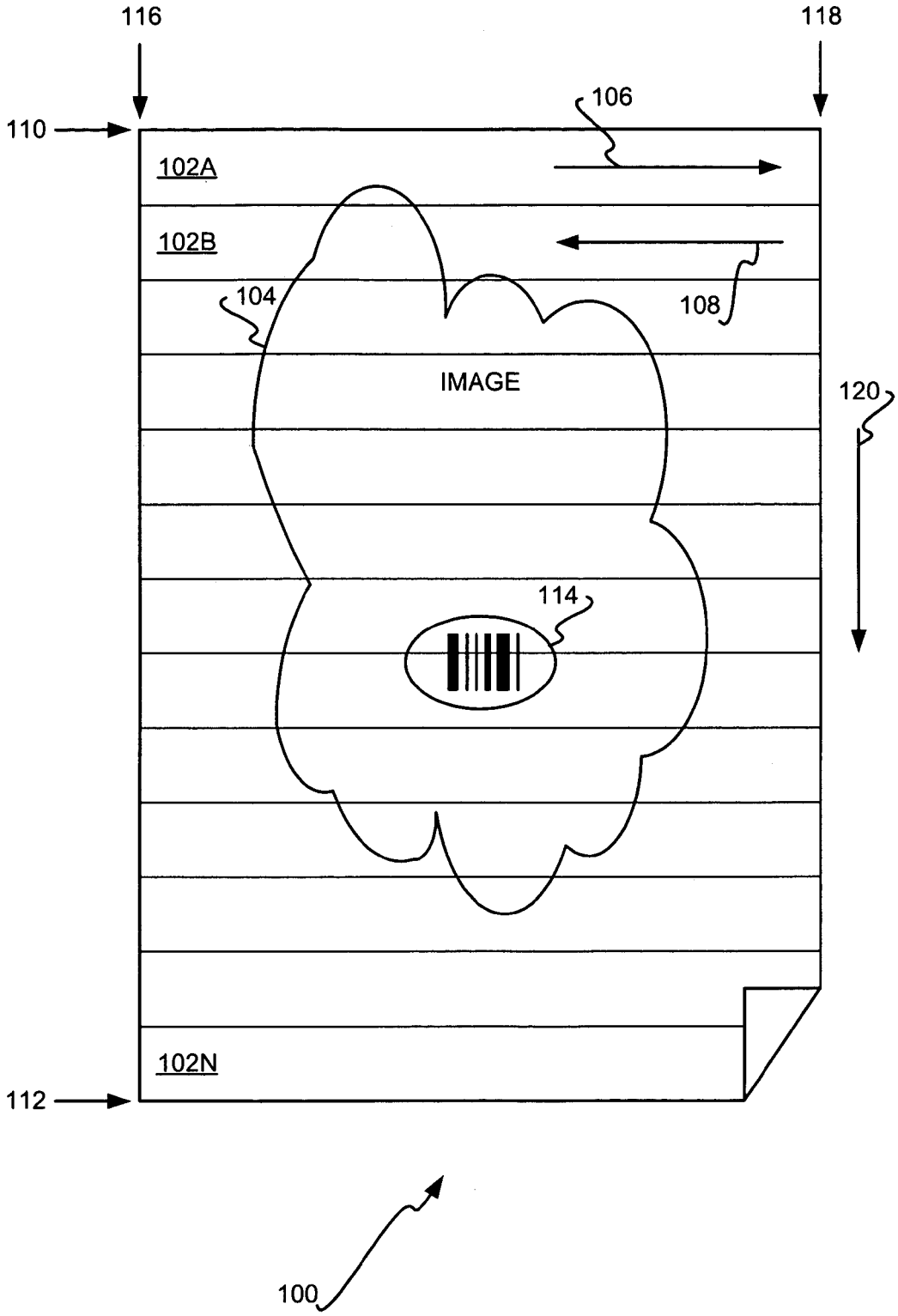
FIG. 1 is a diagram showing a bar code that may be formed on consecutive swaths by an image-formation device, in conjunction with which embodiments of the invention may be implemented.

FIG. 1 shows a media sheet 100 depicting how a bar code may be formed over two consecutive swaths, in conjunction with which embodiments of the invention may be implemented. An image-formation device, such as an inkjet-printing device, forms an image 104 on the media sheet 100 by having an image-formation mechanism thereof, such as an inkjet-printing mechanism including one or more inkjet printheads, be scanned over individual swaths 102A, 102B, . . . , 102N of the media sheet 100. The swaths 102A, 102B, . . . , 102N are collectively referred to as the swaths 102. A swath can be defined as a portion of the image 104 to be formed on the media sheet 100 from at most a first edge 116 of the sheet 100 to at most a second edge 118 of the sheet 100. The swath has a height defined by the image-formation mechanism of the image-formation device itself, and is the largest portion of the image 104 that can be formed by the image-formation mechanism in the direction 120 of media sheet advancement at a given time.

Therefore, the image 104 is formed on the media sheet 100 as follows. The image-formation mechanism is scanned over each swath containing a portion of the image 104, forming the portion of the image 104 corresponding to a given swath as it is scanned over that swath. For instance, the image-formation mechanism may first be positioned over the swath 102A. Therefore, the image-formation mechanism is scanned in the direction 106 from the edge 116 to the edge 118 over the swath 102A, forming the portion of the image 104 that corresponds to this swath. Next, the media sheet 100 is advanced in the direction 120 so that the image-formation mechanism is then positioned over the swath 102B. The image-formation mechanism is scanned in the opposite direction 108 from the edge 118 to the edge 116 over the swath 102B, forming the portion of the image 104 that corresponds to this swath. This process is repeated until the entire image 104 has been formed.

As can be appreciated by those of ordinary skill within the art, several adaptations can be made to this basic swath-by-swath process of image formation on the media sheet 100, which may be a sheet of paper or another type of media. First, the image-formation mechanism typically is not scanned over those of the swaths 102 that do not contain a portion of the image 104 to be formed on the media sheet 100. As such, the media sheet 100 is typically advanced to the next swath of the media sheet 100 that contains a portion of the image 104 to be formed. Second, the image-formation mechanism may be scanned over each swath more than one time so that additional ink, for instance, may be ejected onto each swath.

Third, whereas the swaths 102 are shown in FIG. 1 as extending from a top edge 110 of the media sheet 102 to a bottom edge 112 of the sheet 102, and from a first edge 116 of the media sheet 102 to a second edge 118 of the sheet 102, not all image-formation devices are capable of forming images on the entirety of the media sheet 102. For instance, the first swath 102A on which ink may be able to be ejected may be a distance down from the top edge 110 of the media sheet 102, and the last swath 102N on which ink may be able to be ejected may be a distance up from the bottom edge 112 of the sheet 102. As another example, the swaths 102 may actually start a distance inwards from either or both of the edges 116 and 118 of the media sheet 100. Other adaptations are also amenable to embodiments of the invention.

The image-formation mechanism of the image-formation device that is to form the image 104 on the media sheet 100 is itself said to have a swath, which is the largest portion of the image 104 that can be formed by the image-formation mechanism in the direction 120 of media sheet advancement at a given time. Furthermore, the image 104 is depicted in FIG. 1 as being a contiguous image, when in fact the image 104 may be a number of discontiguous image portions over the media sheet 100. The term image is used in a general and all-encompassing sense herein. Thus, the image 104 to be formed on the media sheet 100 is inclusive of text as well as graphics, for instance.

The image 104 contains a bar code 114. The bar code 114 is a series of vertical lines that can be of varying thickness, and separated by gaps of varying thickness. The bar code 114 has an overall height in the direction 120 that is less than the height of one of the swaths 102. Furthermore, as depicted in FIG. 1, the bar code 114 is formed over two consecutive of the swaths 102. Embodiments of the invention detect that the bar code 114, having a height less than that of a swath, will be formed over two consecutive swaths, and is said to adjust the swath of the image-formation mechanism so that the bar code 114 is instead formed within a single swath by the image-formation mechanism. Different approaches for adjusting the swath of the image-formation mechanism so that the bar code 114 is formed within a single swath are now described.

Figure 2:
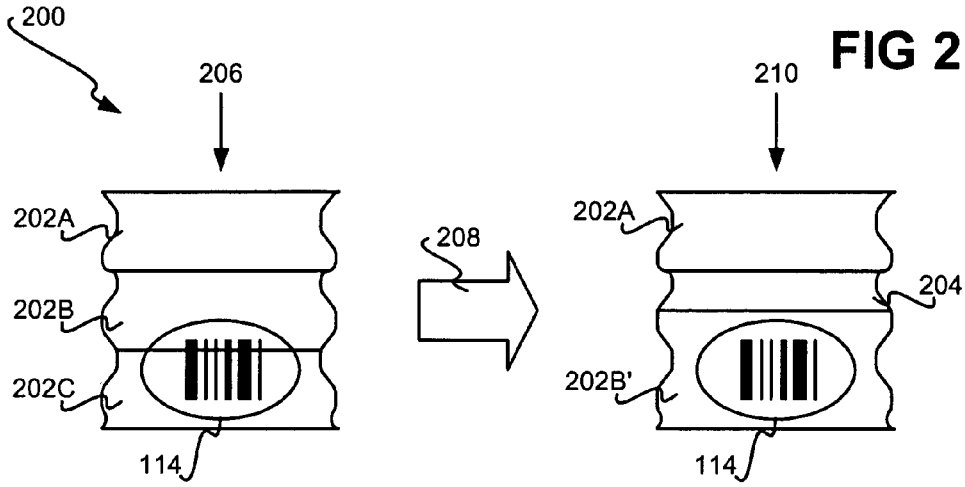
FIG. 2 is a diagram showing how a short media advance can be performed before forming a bar code to result in the bar code being formed in a single swath, according to an embodiment of the invention.

FIG. 2 shows a diagram 200 depicting how a short media advance can be performed to result in a bar code being formed within a single swath by an image-formation mechanism of an image-formation device, according to an embodiment of the invention. In the left part 206 of the diagram 200, the bar code 114 is to be formed over two consecutive swaths 202B and 202C, where the swath 202A is the swath immediately adjacent to and before the swath 202B. An embodiment of the invention detects that the bar code 114 is to be formed over the two consecutive swaths 202B and 202C, and performs an adjustment, indicated by the arrow 208, to the swath of the image-formation mechanism of the image-formation device as follows so that the bar code 114 is instead formed in a single swath.

Therefore, in the right part 210 of the diagram 200, after the swath 202A, a short media advance 204 is performed before forming the swath 202B'. This results in the bar code 114 being completely formed within the single swath 202B'. That is, the embodiment of the invention detects that the bar code 114 is to be formed over the two consecutive swaths 202B and 202B, and before forming the bar code 114, inserts or performs a short media advance 204 so that the bar code 114 is actually formed within the single swath 202B'. The swath 202B' is indicated as a primed version of the swath 202B to denote that it is moved downward by the height of the media advance 204 as compared to the swath 202B. However, the bar code 114 is itself formed in the same location on the media sheet in the right part 210 as intended in the left part 206.

The short media advance 204 desirably has a height less than the height of any of the swaths 202A, 202B, and 202C. Furthermore, the height of the short media advance 204 is determined so that the swath 202B' that results allows the bar code 114 to be formed completely within the swath 202B' in the right part 210 of the diagram 200, instead of over the two swaths 202B and 202C as in the left part 206 of the diagram 200. The short media advance 204 is depicted in FIG. 2 as being performed immediately before formation of the bar code 114. As such, the area covered by short media advance 204 should not include any other image portions to be formed by the image-formation device.

In other embodiments of the invention, the short media advance 204 may be performed at other locations of the media sheet on which the bar code 114 is to be formed. For instance, in one embodiment, the short media advance 204 may be performed at the beginning of this media sheet. In other embodiments, the short media advance 204 may be performed elsewhere relative to the media sheet, so long as the advance 204 is performed before the bar code 114 has been formed. For example, if there is a section of the media sheet on which the bar code 114 is to be formed on which other image portions are not to be formed, and that are located above where the bar code 114 is to be formed, the short media advance 204 may be performed within this section of the media sheet. It is noted that the performance of the short media advance 204 is considered herein as an adjustment to the swath of the image-formation mechanism of the image-formation device.

Figure 3:
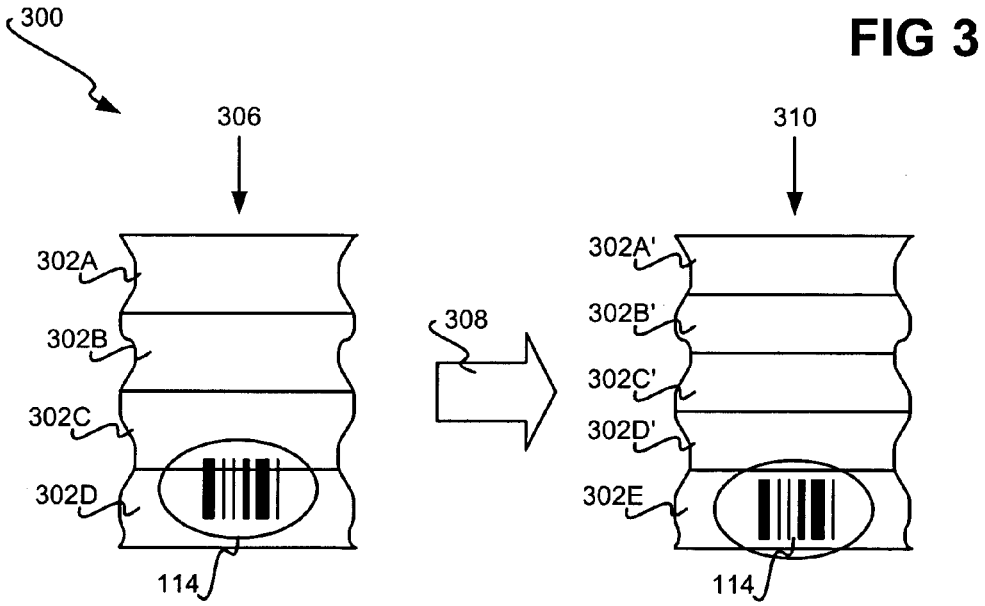
FIG. 3 is a diagram showing how the media advancements performed during image formation on a media sheet can be scaled to less than the height of a single swath so that a bar code is able to be formed in a single swath, according to an embodiment of the invention.

FIG. 3 shows a diagram 300 depicting how media advancements can be scaled to result in a bar code being formed within a single swath by an image-formation mechanism of an image-formation device, according to an embodiment of the invention. In the left part 306 of the diagram 300, the bar code 114 is to be formed over two consecutive swaths 302C and 302D, where the swath 302B is the swath immediately adjacent to and before the swath 302C, and the swath 302A is the swath immediately adjacent to and before the swath 302B. Thus, assuming each of the swaths 302A, 302B, 302C, and 302D contain image portions to be formed on a media sheet (although only the bar code 114 is specifically shown in FIG. 3), the image-formation mechanism would be scanned over the swath 302A to form the image portion corresponding to this swath.

A media advance would then be performed equal to the height of each of the swaths 302A, 302B, 302C, and 302D so that the image-formation mechanism is positioned over the swath 302B. The mechanism would be scanned over the swath 302B to form the image portion corresponding to this swath. Another media advance equal to the height of a swath would be performed so that the mechanism is positioned over the swath 302C, and the mechanism would be scanned over the swath 302C to form the image portion corresponding to this swath. Finally, a media advance would be performed so that the image-formation mechanism is positioned over the swath 302D, and the mechanism would be scanned over the swath 302D to form the image portion corresponding to this swath.

However, an embodiment of the invention detects that the bar code 114 is to be formed over the two consecutive swaths 302C and 302D, and performs an adjustment, indicated by the arrow 308, to the swath of the image-formation mechanism of the image-formation device as follows so that the bar code 114 is instead formed in a single swath. Therefore, in the right part 310 of the diagram 300, the media advance performed before each of the swaths 302A', 302B', 302C', and 302D' is scaled, or decreased, so that the bar code 14 is actually formed within a single swath 302E. That is, in the left part 306, the media advance performed before each of the swaths 302A, 302B, and 302C has a height so that a largest possible swath of the image-formation mechanism can be scanned over next by the mechanism. By comparison, in the right part 206, the media advance performed before each of the swaths 302A', 302B', 302C', and 302D', is scaled, or decreased, so that the amount advanced is less than the largest possible swath of the image-formation mechanism.

The result is that the single swath 302E contains the bar code 114 completely, so that the bar code 114 is formed completely within the single swath 302E. The bar code 114 is itself formed in the same location on the media sheet in the right part 310 as intended in the left part 306. The scaling, or decreasing, of the media advances before each of the swaths 302A', 302B', 302C', and 302D' results in the swaths 302A', 302B', 302C', and 302D' themselves being scaled or decreased in height, although the height of the swath 302E is the same as the swaths 302A, 302B, 302C, and 302D. Thus, whereas in the left part 306 the three larger-in-height swaths 302A, 302B, and 302C are sufficient to cover the area from the top of the swath 302A to the top of the bar code 114, in the right part 310 four of the smaller-in-height swaths 302A', 302B', 302C', and 302D' are needed to cover the area from the top of the swath 302A to the top of the bar code 114. The swaths 302A', 302B', 302C' and 302D' are therefore indicated as primed versions of the swaths 302A, 302B, 302C, and 302D to denote that they are smaller in height, resulting from shorter media advances.

The number of media advances that are scaled, and thus the number of swaths that are scaled, so that the bar code 114 is formed within the single swath 302E can vary between one and all of the media advances that are performed before the bar code 114 is formed. For instance, in FIG. 3, in another embodiment, only the media advancement before the swath 302C may be decreased, or scaled, from the left part 306 to the right part 310, instead of before each of the swaths 302A, 302B, and 302C as is shown in FIG. 3. As another example, all of the swaths from the top of the media sheet on which the bar code 114 is being formed to just before where the bar code 114 is being formed can be scaled, or decreased. The scaling, or decreasing, of the media advances in FIG. 3 is considered herein as an adjustment to the swath of the image-formation mechanism of the image-formation device. Furthermore, whereas two examples of such swath adjustments have been described in relation to FIGS. 2 and 3, in other embodiments other types of swath adjustments may be made so that bar codes are formed in a single swath.

Figure 4:
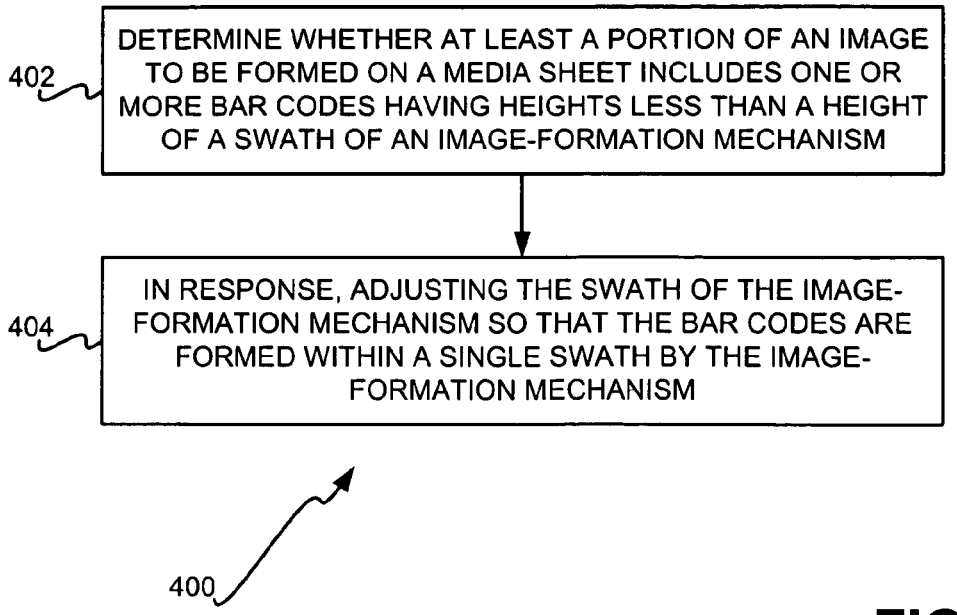
FIG. 4 is a method for adjusting the swath of an image-formation mechanism so that bar codes are formed within a single swath, according to an embodiment of the invention.

FIG. 4 shows a method 400 for ensuring that bar codes are formed within a single swath by an image-formation mechanism of an image-formation device that forms images on media sheets on a swath-by-swath basis, according to an embodiment of the invention. The method 400 may be implemented as one or more computer programs or computer program parts. The method 400 may be performed by the image-formation device itself, or by a host computing device communicatively coupled to the image-formation device.

The method 400 first determines whether at least a portion of an image to be formed on a media sheet on a swath-by-swath basis by an image-formation mechanism of an image-formation device includes one or more bar codes having heights less than the height of a swath of the image-formation mechanism (402). The image-formation device may be an inkjet-printing device, like an inkjet printer, where the image-formation mechanism is thus an inkjet-printing mechanism. In one embodiment, 402 is performed by parsing image data representing the image that is formatted in accordance with a printer control language. Such image data may include one or more defined objects or other entities that specifically represent corresponding bar codes. In another embodiment, the image data may be raw image data, such that analysis thereof is performed to search for a series of vertical lines interspersed with vertical white spaces, each such series constituting a bar code.

In response, the method 400 adjusts the swath of the image-formation mechanism so that the bar codes are formed within a single swath by the image-formation mechanism (404). In one embodiment, a short media advance may be performed prior to forming the bar codes on the media sheet so that they are each formed within a single swath, as has been described in relation to FIG. 2. The short media advance may be performed prior to formation of any of the bar codes on the media sheet, and/or immediately prior to forming at least one of the bar codes on the media sheet. In another embodiment, the swath of the image-formation mechanism may be adjusted by reducing or scaling a media sheet advance performed after each swath of the image is formed, so that the bar codes are each formed within a single swath, as has been described in relation to FIG. 3.

Figure 5:
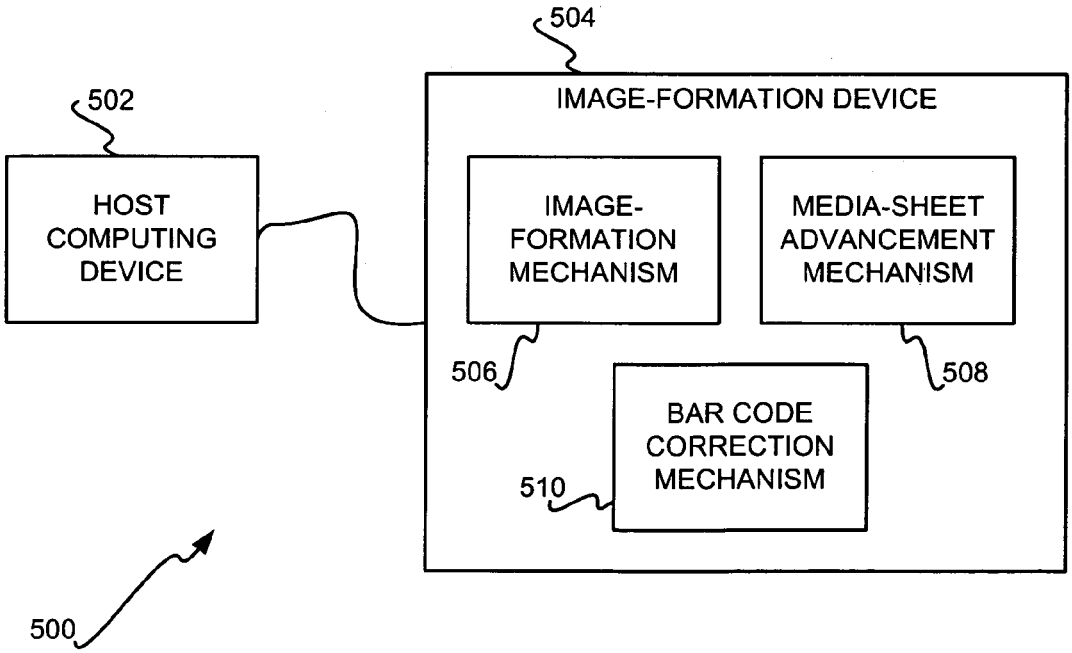
FIG. 5 is a diagram of a system including a host computing device and an image-formation device, such as an inkjet-printing device, according to an embodiment of the invention.

FIG. 5 shows a representative system 500, according to an embodiment of the invention. The system 500 includes a host computing device 502 and an image-formation device 504 that are communicatively coupled to one another in a wireless, wired, and/or networked manner. The host computing device 502 may be a laptop computer, a desktop computer, a personal digital assistant (PDA) device, a mobile phone device, or another type of computing device. The host computing device 502 generates image data representing one or more images to be formed on one or more media sheets by the image-formation device 504.

The image-formation device 504 includes an image-formation mechanism 506, a media-sheet advancement mechanism 508, and optionally a bar code correction mechanism 510. The image-formation mechanism 506 is to form an image on a media sheet on a swath-by-swath basis. For instance, the image-formation mechanism 506 may be an inkjet-printing mechanism, such that the image-formation device 504 is an inkjet-printing device, where the mechanism 506 includes the components needed to eject ink onto media on a swath-by-swath basis. As such, the mechanism 506 may include one or more inkjet printheads, one or more supplies or reservoirs of ink, a carriage on which the printheads move back and forth over a current swath, and so on.

The media-sheet advancement mechanism 508 advances the media sheet after the image-formation mechanism 506 has formed a portion of an image on a current swath so that the image-formation mechanism 506 is positioned over a new swath for formation of another portion of the image thereon. The media-sheet advancement mechanism 508 thus includes the components needed to so advance the media sheet past the image-formation mechanism 506. As such, the media-sheet advancement mechanism 508 may include rollers, motors, and other components. In the embodiment of the invention where the bar code correction mechanism 510 is present, the mechanism 510 may include software, hardware, or a combination of hardware and software, to perform the method 400 that has been described.

Thus, the bar code correction mechanism 510 is to determine whether the image contains bar codes, and to adjust an amount by which the media sheet is advanced by the media-sheet advancement mechanism 508 so that the bar codes are each formed within a single swath by the image-formation mechanism 506, where the bar codes are each less than the height of a swath. The mechanism 510 may perform this adjustment as has been described in relation to FIGS. 2 and 3, for instance. Where the bar code correction mechanism 510 is not present, the host computing device 502 performs this adjustment. Furthermore, even where the mechanism 510 is present, in another embodiment of the invention, the host computing device 502 still performs this adjustment so that the bar codes are each formed within a single swath.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. A method comprising:

determining whether at least a portion of an image to be formed on a media sheet on a swath-by-swath basis by an image-formation mechanism includes one or more bar codes having a height that is less than a height of a swath of the image-formation mechanism;

adjusting the swath of the image-formation mechanism so that the bar codes are formed as part of the image on the media sheet within a single swath by the image-formation mechanism;

wherein adjusting the swath of the image-formation mechanism comprises either performing a short media sheet advance prior to forming the bar codes on the media sheet or reducing a media sheet advance performed after each swath of the image is formed by the image-formation mechanism so that the bar codes are formed within a single swath by the image-formation mechanism.

2. The method of claim 1, wherein adjusting the swath of the image-formation mechanism comprises performing a short media sheet advance prior to forming the bar codes on the media sheet, and wherein the short media sheet advance is performed prior to forming any of the portion of the image on the media sheet.

3. The method of claim 1, wherein adjusting the swath of the image-formation mechanism comprises performing a short media sheet advance prior to forming the bar codes on the media sheet, and wherein the short media sheet advance is performed immediately prior to forming one of the bar codes on the media sheet.

4. The method of claim 1, wherein determining whether at least the portion of the image includes the bar codes comprises parsing image data representing at least the portion of the image and formatted in accordance with a printer control language for data signified by the printer control language as corresponding to a bar code.

5. The method of claim 1, wherein determining whether at least the portion of the image includes the bar codes comprises analyzing image data representing at least the portion of the image for a series of vertical lines interspersed with vertical white spaces.

6. An image-formation device comprising:

an image-formation mechanism to form an image on a media sheet on a swath-by-swath basis;

a media-sheet advancement mechanism to advance the media sheet after each swath of the image has been formed on the media sheet by the image-formation mechanism; and, a bar-code correction mechanism to determine whether the image contains one or more bar codes and to adjust an amount by which the media sheet is advanced by the media-sheet advancement mechanism so that the bar codes are each formed within a single swath by the image-formation mechanism.

7. The image-formation device of claim 6, wherein the bar-code correction mechanism is to cause the media-sheet advancement mechanism to perform a short media sheet advance less than a height of the swath prior to the image-formation mechanism forming any part of the image on the media sheet, so that the bar codes are each formed within a single swath by the image-formation mechanism.

8. The image-formation device of claim 6, wherein the bar-code correction mechanism is to cause the media-sheet advancement mechanism to perform a short media sheet advance less than a height of the swath immediately prior to the image-formation mechanism forming each bar code on the media sheet, so that the bar codes are each formed within a single swath by the image-formation mechanism.

9. The image-formation device of claim 6, wherein the bar-code correction mechanism is to cause the media-sheet advancement mechanism to perform a media sheet advance less than a height of the swath prior to the image-formation mechanism forming each swath of the image on the media sheet, so that the bar codes are formed within a single swath by the image-formation mechanism.

10. The image-formation device of claim 6, wherein the image-formation mechanism comprises an inkjet-printing mechanism, such that the image-formation device is an inkjet-printing device.

11. An image-formation device comprising:

first means for forming an image on a media sheet on a swath-by-swath basis;

second means for advancing the media sheet after each swath of the image has been formed on the media sheet by the first means; and, third means for determining whether the image contains one or more bar codes and for adjusting an amount by which the media sheet is advanced by the second means so that the bar codes are each formed within a single swath by the first means.

12. The image-formation device of claim 11, wherein the third means is for causing the second means to perform a short media sheet advance less than a height of the swath prior to the first means forming any part of the image on the media sheet.

13. The image-formation device of claim 11, wherein the third means is for causing the second means to perform a short media sheet advance less than a height of the swath immediately prior to the first means forming each bar code on the media sheet.

14. The image-formation device of claim 11, wherein the third means is for causing the second means to perform a media sheet advance less than a height of the swath prior to the first means forming each swath of the image on the media sheet.

15. A computer-readable medium having a computer program stored thereon comprising:

a first computer program part to determine whether at least a portion of an image to be formed on a media sheet on a swath-by-swath basis induces one or more bar codes having a height that is less than a height of a swath; and, a second computer program part to adjust the swath so that the bar codes are formed on the media sheet within a single swath; and wherein the second computer program part is to cause a short media sheet advance to be performed prior to any of the portion of the image being formed on the media sheet.

16. The computer-readable medium of claim 15, wherein the second computer program part is to cause a short media sheet advance to be performed immediately prior to each bar code being formed on the media sheet.

17. The computer-readable medium of claim 15, wherein the second computer program part is to decrease a media sheet advance performed after each swath of the image is formed.

18. The computer-readable medium of claim 15, wherein the computer program is performed by a host computing device communicatively coupled to an image-formation device that forms the image on the media sheet.

19. The computer-readable medium of claim 15, wherein the computer program is performed by an image-formation device that forms the image on the media sheet.

* * * * *

UNITED STATES PATENT AND TRADEMARK OFFICE

CERTIFICATE OF CORRECTION

PATENT NO. : 7,163,271 B2
APPLICATION NO. : 11/010044
DATED : January 16, 2007
INVENTOR(S) : Antoni S Murcia et al.

It is certified that error appears in the above-identified patent and that said Letters Patent is hereby corrected as shown below:

In column 9, line 8, in Claim 15, delete "induces" and insert -- includes --, therefor.

Signed and Sealed this

First Day of September, 2009

David J. Kappos

David J. Kappos
*Director of the United States Patent and Trademark Office*